US005312496A

United States Patent [19]

Ames

[11] Patent Number: 5,312,496

[45] Date of Patent: May 17, 1994

[54] SKIN PASS ROLLING OF MECHANICALLY SCRIBED SILICON STEEL

[75] Inventor: S. Leslie Ames, Sarver, Pa.

[73] Assignee: Allegheny Ludlum Corporation, Pittsburgh, Pa.

[21] Appl. No.: 977,345

[22] Filed: Nov. 17, 1992

[51] Int. Cl.[5] ..... H01F 1/04

[52] U.S. Cl. ..... 148/111

[58] Field of Search ..... 148/111, 112; 72/187, 72/199, 366.2

[56] References Cited

U.S. PATENT DOCUMENTS

| | | | |
|---|---|---|---|
| 4,533,409 | 8/1985 | Benford | 148/111 |
| 4,711,113 | 12/1987 | Benford | 72/197 |
| 4,742,706 | 5/1988 | Sasaki et al. | 72/241 |
| 4,770,720 | 9/1988 | Kobayashi et al. | 148/111 |
| 5,080,326 | 1/1992 | Price et al. | 266/103 |
| 5,123,977 | 6/1992 | Price et al. | 148/111 |
| 5,143,561 | 9/1992 | Kitamura et al. | 148/111 |

*Primary Examiner*—John P. Sheehan

*Attorney, Agent, or Firm*—Patrick J. Viccaro

[57] ABSTRACT

A grain oriented silicon steel strip is flattened by a skin pass rolling to flatten undulations caused by scribe lines imparted to the strip for mechanically refining the magnetic domain wall spacings.

11 Claims, 1 Drawing Sheet

SKIN PASS ROLLING OF MECHANICALLY SCRIBED SILICON STEEL

CROSS REFERENCE TO RELATED APPLICATIONS

This application is related to U.S. patent application Ser. No. 07/977,584; Ser. No. 07/978,204; Ser. No. 07/977,359; Ser. No. 07/978,202; and Ser. No. 07/977,595; all filed Nov. 17, 1992.

BACKGROUND OF THE INVENTION

1. Field of the Invention

This invention relates to imparting a skin pass rolling operation to a grain oriented silicon steel strip subsequent to mechanical refinement of the magnetic domain spacing by patterns of scribe lines extending in a direction transversely of the strip.

2. Description of the Prior Art

Grain-oriented silicon steel is conventionally used in electrical applications, such as power transformers, distribution transformers, generators, and the like. The steel's ability to permit cyclic reversals of the applied magnetic field with only limited energy loss is a most important property. A reduction of this loss, which is termed "core loss", is highly desirable in the aforesiad electrical applications.

In the manufacture of grain-oriented silicon steel, it is known that the Goss secondary recrystallization texture, (110)[001]in terms of Miller's indices, results in improved magnetic properties, particularly permeability and core loss over non-oriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon; casting the melt; hot rolling; cold rolling the steel to final gauge typically of 7 or 9 mils, and up to 14 mils in one or more cold rolling stages, with intermediate annealing when two or more cold rollings are used; decarburizing the steel; applying a refractory oxide base coating, such as a magnesium oxide coating, to the steel; and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein, during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel; and second, high permeability, grain-oriented silicon steel. Regular, grain-oriented silicon steel is generally characterized by a permeability of less than 1870 at 10 Oersteds. High permeability, grain-oriented silicon steels are characterized by higher permeabilities which may be the result of composition changes alone or together with process changes. For example, high permeability silicon steels may contain nitrides, sulfides, selenides, and/or borides which contribute to the particles of the inhibition system which is essential to the secondary recrystallization process for the steel. Furthermore, such high permeability silicon steels generally undergo greater cold reduction to final gauge than regular grain oriented steels. A heavy final cold reduction on the order of greater than 80% is generally made in order to facilitate the high permeability grain orientation. While such higher permeability materials are desirable, such materials tend to produce larger magnetic domains than conventional material. Generally, larger domains are detrimental to core loss.

Once the steel obtains the grain-oriented texture, any subsequent cold rolling of the steel sheet is highly undesirable. It is well known that such rolling of the main body of the steel leads to unrecoverable deterioration in magnetic properties of the steel. The grain-oriented texture becomes disrupted as a result of such rolling.

It is known that one of the ways that domain size and thereby core loss values of electrical steels may be reduced occurs when the steel is subjected to any one of various practices designed to induce localized strains in the surface of the steel. Such practices may be generally referred to as "domain refining by scribing" and are performed after the final high temperature annealing operation. If the steel is scribed after the final texture annealing, then a localized stress state in the texture-annealed sheet is induced so that the domain wall spacing is reduced. These disturbances typically are relatively narrow, straight line patterns, or scribes, generally spaced at regular intervals. The scribe lines are substantially transverse to the rolling direction and typically are applied to only one side of the steel.

In fabricating electrical steels into transformers, the steel inevitably suffers some deterioration in core loss quality due to cutting, bending, and construction of cores during fabrication, all of which impart undesirable stresses in the material. During fabrication incidental to the production of stacked core transformers and, more particularly, power transformers in the United States, the deterioration in core loss quality due to fabrication is not so severe that a stress relief anneal (SRA), typically about 1475° F. (801° C.), is essential to restore properties. It is accordingly frequent practice not to apply this anneal. Thus, for such end uses, the need is for a flat, domain-refined silicon steel which will not necessarily be subjected to stress relief annealing. In other words, the scribed steel used for this purpose does not have to possess domain refinement which is resistant to the heating of a stress relief anneal.

However, during the fabrication incidental to the production of most distribution transformers in the United States, the steel strip is cut and subjected to various bending and shaping operations which produce more working stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

In referring now to certain prior teaching, U.S. Pat. Nos. 4,533,409, issued Dec. 19, 1984 and 4,711,113, issued Dec. 8, 1987, disclose a method and apparatus for scribing a grain-oriented silicon steel to refine the grain structure by passing the cold strip through a roll pass defined by an anvil roll and scribing roll having a surface with a plurality of projections extending along and generally parallel to the roll axis. The anvil roll is typically constructed from a material that is relatively more elastic than the material from which the scribing roll is constructed. Preferably, the scribing roll is constructed from steel and the anvil roll is constructed from rubber. The process described in U.S. Pat. No. 4,711,113, may be performed before or after final texture annealing but the domain refinement achieved is not maintained through the usual stress relief annealing temperatures.

U.S. Pat. No. 4,742,706, issued May 10, 1988, discloses an apparatus for imparting strain to a moving steel sheet at linear spaced-apart, deformed regions. The apparatus includes a strain imparting roll having a plurality of projections as in the above described U.S. Pat. No. 4,711,113, except that the projections are formed on a spiral relative to the axes of rotation of the roll. The apparatus of the '706 patent also includes a press roll, a plurality of back-up rolls and a fluid pressure cylinder interconnected so as to control pressure against the press roll.

U.S. Pat. No. 4,770,720, issued Sep. 13, 1988 discloses a cold deformation technique wherein final texture annealed grain oriented silicon steel at as low as room temperature, and as high as from 50° to 500° C. (122° to 932° F.) is subjected to local loading, at a mean load of 90 to 220 kg/mm$^2$ to (127,000 to 325,000 PSI) to form spaced apart grooves. The sheet must then be annealed at 750° C. (1380° F.) or more so that fine recrystallized grains are formed to divide the magnetic domains and improve core loss values which survive subsequent stress relief annealing.

In U.S. Pat. Nos. 5,080,326, issued Jan. 14, 1992 and 5,123,977, issued Jun. 23, 1992 and assigned to the same assignee of this patent application, a hot deformation technique is disclosed wherein the steel sheet is heated to a temperature in the range of 1000° F. to 1400° F. (540° C. to 760° C.) and while in this state it is locally hot deformed to facilitate the development of localized fine recrystallized grains in the vicinity of the areas of localized deformations to effect heat resistant domain refinement and core loss.

While the above prior attempts have, to different degrees, met the basic objectives to which they were addressed, they have created other technical and practical problems which the present invention is designed to overcome. One such problem is the stacking factor of the core assembly of the transformer. The stacking factor has reference to the efficiency of packing a stack of lamination with a maximum number of scribed sheets as compared to solid steel in a given cross section which are used to make up a transformer core assembly. Numerically, the term stacking factor is expressed as a percent ratio of a theoretical stacking height, i.e., calculated from weight, volume and density, to actual height under a given pressure. A high stacking factor permits more magnetic flux-carrying material in a given core volume. A 100% stacking factor is ideal although conventional flat electrical sheets yield a stacking factor on the order of 95%. Corrugations of the type developed as a result of mechanical scribing consisting of a multiplicity of closely spaced scribe lines traversing the strip are deleterious to the stacking factor although greatly beneficial to the refinement of magnetic domain wall spacing.

The stacking factor affects the capacity or power rating and size of the transformer and hence the ultimate use and cost. The stacking dimension is "enlarged" by the degree of penetration of the localized deformations cause by scribing and the non-uniformity in a linear direction of the deformations, (i.e. variation in the depth of the deformations). These two conditions of non-uniformity and excessive penetration of some of prior deformation techniques are also objectionable because they create problems in operation of the core-winding machine and gap patterns of the elements of the core and in the ease of moving and manipulating the scribed sheets during processing in the manufacturing of the transformers.

SUMMARY OF THE INVENTION

In accordance with the present invention there is provided a method of providing a flatter surface on cube-on-edge grain-oriented silicon steel strip having a refined magnetic domain wall spacing by mechanical scribing formed by a multiplicity of closely spaced scribe lines extending generally transversely across the width of the strip forming localized undulations to the strip surface. Contrary to the prior art, the method comprises skin pass rolling the domain refined grain-oriented steel strip with rolling pressure sufficient essentially only to flatten undulations due to the scribing. An important feature of the invention is that the skin pass rolling localizes any deformation to the scribe line undulations in the strip.

BRIEF DESCRIPTION OF THE DRAWINGS

The above and other objects and features of the invention will become more apparent from the following detail description taken in connection with the accompanying drawings which form a part of this specification and in which.

DETAILED DESCRIPTION OF THE PREFERRED EMBODIMENT

Figure 1:
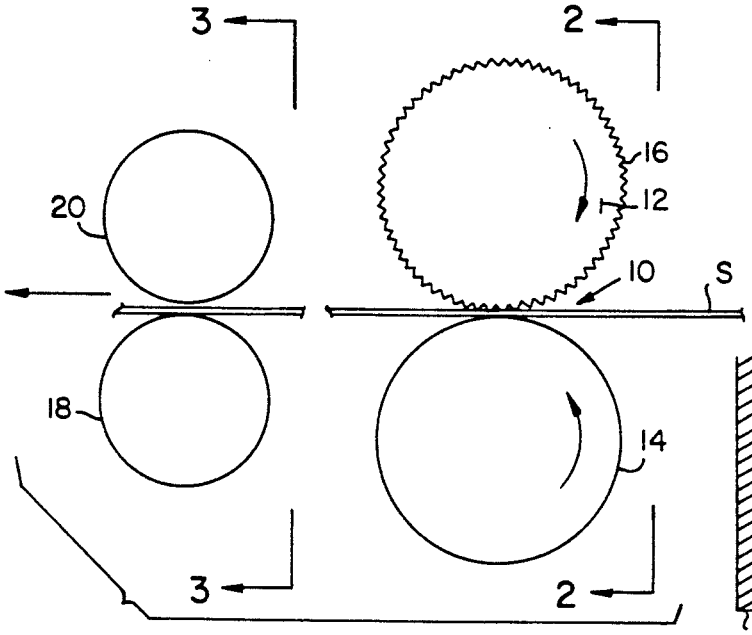
FIG. 1 is an elevational view of a preferred form of apparatus to practice the present invention.
Figure 2:
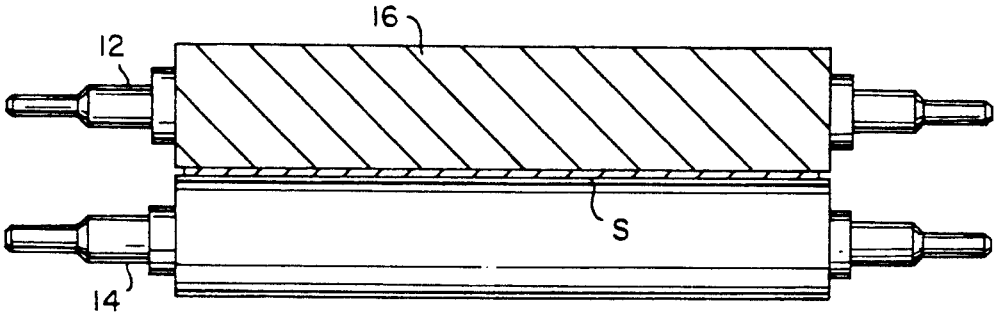
FIG. 2 is a partial sectional view taken along lines II—II of FIG. 1.
Figure 3:
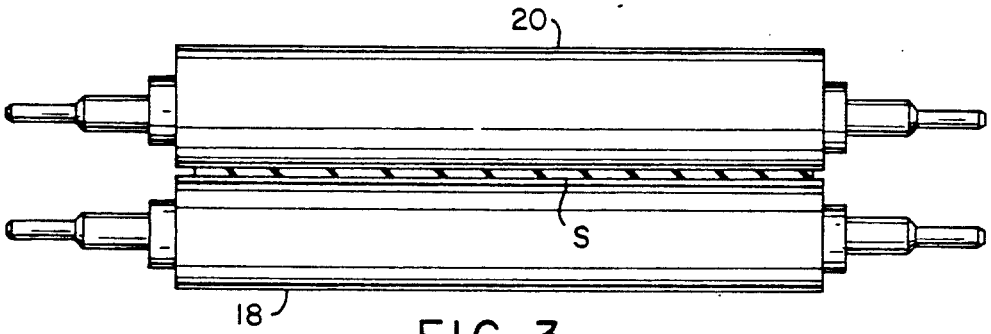
FIG. 3 is a partial sectional view taken along lines III—III of FIG. 1.

With reference to FIGS. 1-3, there is illustrated an arrangement of apparatus useful to perform the method employing skin pass rolling to enhance the quality of an electrical steel strip product having a refined domain structure according to the present invention. The domain refinement is carried out by local mechanical deformation irrespective of whether the steel is at elevated temperature or not.

As shown, a strip S is passed into a rolling contact pressure area 10 formed by the cooperation of the scribing roller 12 and an anvil roller 14 for imposing a mechanical deformation transversely of the strip in the pressure area by a series of outer peripheral surface projections 16 on the body of the scribing roller 12. The anvil roller supports the strip during the scribing operation. In the arrangement shown in FIGS. 1–3, the anvil roll is driven by a motor-gear drive unit in a manner per se well known in the art. The scribe lines can penetrate the steel causing plastic deformation to vary degrees that changes from time to time with heat build-up and strip parameters such as temperature and thickness variations. Such variations give rise to a need to smooth the face surfaces of scribed strip to improve the stacking factor.

The surface projection 16 may take any one of several different forms according to the present invention and FIG. 2 illustrates a helical arrangement of spaced apart projections 16 formed on the outer periphery of the scribing roller. The projections extend the full face length of the roller and are constructed so that the scribe lines produced thereby in the face of the strip always extend in a direction generally transverse to the rolling direction. When the scribing pressure is selected to impart plastic deformation to the base metal of the strip, the refinement to the magnetic domain walls has been found to be heat resistant. Fine recrystallized grains are formed in the strip beneath the plastically deformed surface by annealing the strip after scribing at a temperature of, for example, 1400° F. (760° C.) for one minute or less.

The pattern of scribing ridges may extend across the roll face but change direction between opposite ends of the scribing roller. The pitch or spacing of the scribing ridges as measured between the valleys or scribed grooves defining two adjacent projections may be on the order of 1 to 15 mm, usually between 2 to 10 mm, preferably between 5 and 10 mm, and have a depth on the order of 0.5 to 1.0 mm. The groove formed by each scribing surface extends across the strip at an angle of 45° or less and can have an angle of between 10° to 20° to a line perpendicular to the rolling direction.

Figure 4:
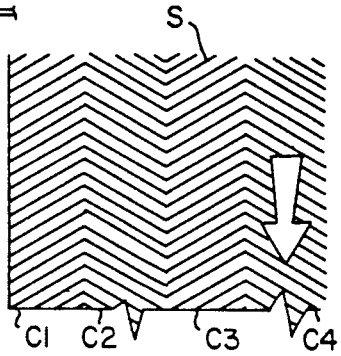
FIG. 4 is a plan view of a preferred arrangement of scribe lines forming chevron patterns across the face of a silicon steel strip.

FIG. 4 illustrates a preferred pattern of scribe ridges which are arranged in columns C1, C2, C3 and C4 such that the angle at which the transversely extending scribe ridges project across the face of the strip in the various columns form a chevron pattern. The apexes of the chevrons fall in common planes parallel with the rolling direction of the strip. Such a chevron pattern of scribe lines in the face of a silicon steel strip for mechanically refining the magnetic domain wall spacing in a silicon strip and a method for producing the same may be obtained according to the teachings of U.S. patent application Ser. No. 07/978,202, filed Nov. 17, 1993 and assigned to the same assignee of this patent application; the disclosure of which has been incorporated herein by this reference.

As a generally accepted proposition in this field of art, cold rolling of the body of grain-oriented silicon steel strip is highly undesirable as it can lead to unrecoverable deterioration in magnetic properties. However, the method of the present invention is based on the discovery that skin pass rolling of such textured strip which has been mechanically scribed is beneficial to the magnetic properties. Particularly, the strip issuing from the rolling contact pressure area 10 enters the gap formed by a pair of rolling mill rolls 18 and 20 comprising part of a skin pass rolling mill that may be of any well known construction. The skin pass rolling operation on the steel operates to reverse some of the deformation caused by the plastic deformation during the scribing process. The skin pass rolling of the present invention should cause no substantial elongation, i.e., a very minimal amount of strip elongation, preferably not more than 0.3%.

The benefit of the skin pass rolling of the mechanically scribed strip may be realized by a stress relief annealing operation carried out before or after the skin pass rolling operation. An annealing operation relieves the stress occurring during the development of domain refinement properties by mechanical scribing. The degree of hardness encountered by undulations in the strip as a result of the scribing operation may affect the pressure required to carry out the skin pass rolling operation. An increase in the rolling pressure due to the skin pass rolling operation may result in an increase of stored energy in the sheet because of the pressure by the flattening of undulations and may cause an increase in the amount of primary grains formed locally at the scribe line during annealing. Thus, if the amount of primaries is below optimum, for example, as a result of wear on the scribing roll, the flattening operation can provide a corrective action through its enhancement of the amount of local scribe-line primary grains.

Examples are shown in the following Table involving two samples from a coil of 9 mil, high permeability steel. Both samples were scribed in accordance with the practice of U.S. Pat. Nos. 5,080,326 and 5,123,977. Both the samples had shown attractive core loss improvements after the scribing plus stress relief annealing (SRA) but had an undesirable corrugated surface condition after the mechanical scribing. The surface smoothness was measured with a Perthometer profilometer, manufactured by Mahr Perthen Co., Germany. The values indicated by the profilometer are in micro-inches and represent the deviation from ideal surface smoothness. The corrugated as scribed samples showed approximately double the deviation of the as-annealed starting material, but returned to slightly over that of the starting material after skin passing with an overall reduction of approximately 0.03%. Although the cold reduction averaged in the above percentage is very small, the cold work was undoubtedly non-uniform and higher in the local scribe area. The corrugations were substantially crushed back into the original flat configuration. The effect of the cold worked lines on magnetic properties (Condition C in the Table) was severely deleterious with core losses rising to almost triple the previous levels. However, after another stress relief anneal (SRA), the stored energy in the prior-corrugated region was relieved by primary recrystallization (Condition D). The core losses of the now flattened strip returned to substantially the level before flattening (Condition B).

TABLE

| Sample No. | Permeability at 10 Oersteds | Core Loss WPP @ 1.5 KG | Core Loss WPP @ 1.7 KG | Surface Smoothness |
|---|---|---|---|---|
| | CONDITION A Parent Coil as Texture Annealed | | | |
| K3-1 | 1910 | .418 | .576 | 200 ± 10 |
| K3-2 | 1910 | .418 | .576 | 200 ± 10 |
| | CONDITION B Condition A + Scribe + SRA | | | |
| K3-1 | 1862 | .393 | .557 | 350–500 |
| K3-2 | 1880 | .393 | .551 | 350–500 |
| | CONDITION C Condition B + Cold Skin Pass | | | |
| K3-1 | 1267 | 1.113 | 1.343 | 210–230 |
| K3-2 | NOT TESTED | | | |

TABLE-continued

| Sample No. | Permeability at 10 Oersteds | Core Loss WPP @ 1.5 KG | Core Loss WPP @ 1.7 KG | Surface Smoothness |
|---|---|---|---|---|
| | CONDITION D Condition C + SRA | | | |
| K3-1 | 1853 | .399 | .565 | 210–230 |
| K3-2 | 1872 | .387 | .553 | 210–230 |

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of providing a flattened surface on final texture annealed cube-on-edge grain-oriented silicon steel strip having a refined magnetic domain wall spacing by mechanical scribing formed by a multiplicity of closely spaced scribe lines extending generally transversely across the width of the strip forming localized undulations to the strip surface, the method comprising skin pass rolling the domain refined strip with rolling pressure sufficient essentially only to flatten undulations due to said scribing.

2. The method of claim 1 wherein the skin pass rolling results in no substantial change in thickness of the sheet.

3. The method of claim 1 wherein the skin pass rolling produces no greater than 0.3% elongation of the sheet.

4. The method of claim 1 wherein said skin pass rolling flattens essentially only the localized undulations defining said closely spaced scribed lines.

5. The method of claim 1 wherein the rolling pressure utilized in the skin pass rolling strip is such as to produce primary grains in the sheet after the stress relief anneal.

6. The method of claim 1 wherein said skin pass rolling is carried out while the strip is at an elevated temperature substantially above room temperature.

7. The method of claim 1 wherein said skin pass rolling is carried out while the strip is at room temperature.

8. The method of claim 1 wherein said skin pass rolling is carried out after stress relief annealing the mechanically scribed strip.

9. The method of claim 1 wherein said skin pass rolling is carried out before stress relief annealing of the mechanically scribed strip.

10. The method of claim 1 wherein said skin pass rolling is carried out on said strip having undulations formed by scribe lines defining a chevron pattern.

11. The method of claim 1 wherein said skin pass rolling improves the core loss of the domain refined strip.

* * * * *